United States Patent [19]

Johnson

[11] 4,383,915

[45] May 17, 1983

[54] CLAY CONTACTING PROCESS FOR REMOVING CONTAMINANTS FROM WASTE LUBRICATING OIL

[75] Inventor: Conrad B. Johnson, Edmonton, Canada

[73] Assignee: Turbo Resources Ltd., Edmonton, Canada

[21] Appl. No.: 339,617

[22] Filed: Jan. 15, 1982

Related U.S. Application Data

[63] Continuation-in-part of Ser. No. 147,197, May 6, 1980, abandoned.

[51] Int. Cl.[3] ..... C10G 25/00; C10G 49/00

[52] U.S. Cl. ..... 208/183; 208/179

[58] Field of Search ..... 208/179, 182, 183; 210/663, 664, 665, 666, 667, 690, 774, 775

[56] References Cited

U.S. PATENT DOCUMENTS

| | | | |
|---|---|---|---|
| 1,823,185 | 9/1931 | Belden | 208/183 |
| 1,898,168 | 2/1933 | Belden | 208/182 |
| 2,045,216 | 6/1936 | Crowley | 208/182 |
| 2,319,598 | 5/1943 | Harris | 208/183 |
| 2,440,680 | 5/1948 | Gerin | 208/179 |
| 3,346,483 | 10/1967 | Somogyi | 208/179 |
| 3,366,551 | 1/1968 | Kaso | 208/182 |
| 3,527,696 | 9/1970 | Wallover | 208/182 |
| 3,930,988 | 1/1976 | Johnson | 208/182 |
| 4,151,072 | 4/1979 | Nowack | 208/182 |

FOREIGN PATENT DOCUMENTS

| | | | |
|---|---|---|---|
| 1279844 | 6/1969 | United Kingdom | 208/179 |

*Primary Examiner*—Ernest G. Therkorn
*Attorney, Agent, or Firm*—Ernest Peter Johnson

[57] ABSTRACT

A process is provided for removing contaminants from waste lubricating oil. The previously untreated waste oil is contacted with decolorizing clay and the mixture is heated to and retained for a period of time at a temperature in the range of about 650°-725° F., to render the mixture filterable. The product clay-oil mixture is cooled and filtered to produce an oil filtrate reduced in contaminants. The clay contacting step may optionally be performed in a hydrogen atmosphere. The oil product can be used for non-critical uses or further upgraded by conventional methods.

13 Claims, No Drawings

CLAY CONTACTING PROCESS FOR REMOVING CONTAMINANTS FROM WASTE LUBRICATING OIL

CROSS-REFERENCE TO RELATED APPLICATION

This application is a continuation-in-part of my application for U.S. Letters Patent Ser. No. 147,197 filed May 6, 1980, now abandoned.

FIELD OF THE INVENTION

The invention relates to a process for removing contaminants from waste lubricating oil. More particularly, the invention involves contacting the oil with clay and heating the mixture at a defined temperature for sufficient time to render the mixture filterable, and thereafter cooling and filtering the mixture to produce a useable oil product.

BACKGROUND OF THE INVENTION

Waste lubricating oils include used motor oil, diesel oil, crankcase oil, and transmission oil. These waste oils contain a number of contaminants arising from both their use and from additives added prior to their use. These contaminants for the most part include calcium, barium, zinc, aluminum and phosphorus arising from detergent dispersant agents, iron from engine wear, lead and light end hydrocarbons from gasoline, and water. In order to reuse these oils, the contaminants must be removed.

Due to the high viscosity of the oil, the fine colloidal or dissolved form of the contaminants and the dispersing nature of the additives, the contaminants cannot be removed by a simple filtration procedure without some preliminary treatment.

Conventionally, waste oils are treated in a process which includes metals removal steps, which steps involve coagulating or precipitating the contaminants and thereafter either filtering the oil or removing the metals in an aqueous phase. Often the oil is then clay contacted to remove further color bodies or metals remaining after the initial metals removal.

One of the most widely used metal removal steps is the acid-clay process. In this process, the light ends are first removed from the oil by steam stripping at a temperature in the range of about 500°-650° F. The oil is then contacted with high strength sulphuric acid to precipitate contaminants into the aqueous phase; the contaminants are then removed as an acid sludge. The remaining acidic oil product is thereafter contacted with clay at a temperature in the range of about 300°-600° F. to absorb additional contaminants and color bodies.

There are a number of problems associated with this acid-clay process. Firstly, the process produces large amounts of acid sludge which must be disposed of. Secondly, large volumes of corrosive acid are consumed by the process. Thirdly, up to 20% of the original waste oil is lost with the acid sludge.

Heretofore, the standard practice in this art has involved removing the majority of the contaminants (as by acid contacting), prior to contacting the oil with clay, since it is commonly accepted that the detergent dispersant agents present in the oil rendered the clay-oil mixture unfilterable. Further, high temperature treatments have been avoided when reprocessing waste lubricating oil, to avoid undue cracking of the oil.

SUMMARY OF THE INVENTION

It has been found that a previously untreated waste lubricating oil, containing detergent dispersant agents, may be contacted with decolorizing clay and heated for a specified time at a specified temperature with the result that the so-treated oil-clay mixture may thereafter be directly and successfully cooled and filtered to remove contaminants with the solids and yield a useable oil product. More particularly, in the heating step the mixture is maintained at temperature(s) in the range of about 650°-725° F. for a period of time sufficient to render the mixture amenable to filtration at viable rates. That is, the mixture is readily filterable. For example, if a 500 ml. sample of oil-clay mixture is held at 650° F. for 3-4 hours and then cooled to a conventional filtering temperature, such as 350° F., when filtered under a vacuum of 10 mm Hg, using No. 1 Whatman filter paper, the mixture will successfully filter in less than 30 minutes.

Apparently, the dispersing properties of the detergent dispersing agents and other additives are altered by this treatment, to thereby render the waste oil filterable. While not being bound by the same, it is believed that this high temperature clay-contacting step achieves selective cracking of the detergents and other additives associated with the oil, without causing undue cracking of the oil. This is in contrast to the teaching of the prior art, which was to avoid high temperature treatment of waste oil to limit cracking in the oil.

The filtered oil product is acceptable for further conventional upgrading processes including hydrotreating, vacuum distillation and acid-clay contacting. Alternatively, it is useful as is in non-critical circumstances, such as lubrication of railroad cars.

The process has been demonstrated with a number of known decolorizing clays. Preferably, light ends stripping is performed simultaneously with the clay-contacting step.

In accordance with a preferred version of the invention,the clay contacting step is performed in a hydrogen atmosphere. Noticeable improvements in the odour of the oil are obtained, no doubt due to the hydrogenation of S-containing compounds.

Broadly stated, the invention is a process for the removal of contaminants from untreated waste lubricating oil, containing detergent dispersant agents, comprising the steps of: (a) contacting the untreated waste oil with a decolourizing clay at a temperature in the range of about 650°-725° F. for a time sufficient to render the mixture readily filterable whereby at least a portion of the contaminants may be separated with the clay from the oil; and then (b) immediately cooling and filtering the whole product of step (a) to obtain as a filtrate the greatest part of the oil, reduced in contaminant content.

DESCRIPTION OF THE PREFERRED EMBODIMENT

The process of the present invention is largely practiced on waste lubricating oils which include motor oil, transmission oil, hydraulic oil, crankcase oil, diesel oil and the like. Such oils typically contain about 10% by weight contaminants, which contaminants include both the additives added to the oil and the impurities arising from use of the oil. The major contaminants to be removed include calcium, barium, zinc, aluminum, phosphorous, lead, iron, or compounds thereof, water and hydrocarbon light ends. The light end contaminants include light hydrocarbons from fuel dilution of the waste oil and from thermal or oxidative degradation of the original motor oil or additives.

To practice the process of the present invention, untreated waste lubricating oil, which is generally a mixture of automobile drained oils which has not been previously processed to remove the metal contaminants, is contacted with a decolorizing clay and heated at a temperature in the range 650°-725° F. for a time sufficient to render at least a portion of the contaminants removeable by filtration. Heating at a temperature below about 650° F. results in a clay-oil mixture which is not readily filterable. Performing the clay contacting and heating step above about 725° F. causes undue cracking in the oil. The time needed is temperature dependent. For instance, at temperatures of 650° F., 680° F. and 700° F., reaction times of about 4,2 and 1 hours respectively are usually sufficient.

Decolorizing clays are well known in the art of reclaiming waste lubricating oils. Those decolorizing clays normally used to decolorize waste oil, for instance in the clay contacting step of the conventional acid-clay process, are suitable for the process of the present invention. The process has been demonstrated with Filtrol Clay obtained from Fisher Laboratory Chemicals, Toronto, Ontario; Attapulgus Clay from Engelhard Minerals & Chemicals, Appleton, Wisconsin; and Pembina Clay obtained from Pembina Mountain Clays Ltd., Winnipeg, Manitoba.

The quantity of clay used is preferably in the range of about 2-6% by weight. At less than about 2% clay, the color bodies removal is poor; at greater than about 6% clay, the quantity of oil lost with the clay is considerable.

The clay-oil mixture is then cooled and filtered by, for instance, gravity or vacuum filtration, to produce a filtrate reduced in contaminant content. This filtration step is performed at a temperature at which the filtering equipment is operative. Usually filtering is carried out at a temperature in the range of about 200°-350° F., in order to reduce the oil viscosity and thus increase the filtration rate. The amount of clay used in the clay contacting step has been found to affect the filtration rate. Up to about 4% by weight clay greatly improves the filtration rate. Further increasing the clay content has no further beneficial effect on the filtration rate.

It may be desirable to perform the clay contacting step in a hydrogen atmosphere. Significant improvements in both the odour and filterability of the oil product are thereby obtained. A typical clay contacting-hydrogenation step involves contacting the waste oil with about 2-6% by weight decolorizing clay, in a hydrogen pressure in the range of about 100-800 psig at a temperature in the range of about 650°-675° F. for about 1-2 hours. Temperatures higher than 675° F. generally cause an undue amount of hydrocracking in the oil. The hydrogen pressure range is not critical to the reaction, however pressures outside these limits are more difficult to maintain.

Particularly good results have been obtained when diesel oil is reprocessed by the above described clay contacting-hydrogenation step. This oil is usually difficult to process by other methods since the high molecular weight of the oil approaches the molecular weight of the contaminants.

Since very high temperatures are used in the clay contacting step, it is advantageous to conduct light ends stripping from the oil simultaneously with this step. To that end, the heated oil may be purged with a nitrogen or steam stream during the clay contacting step to remove the volatile light ends, which light ends are recovered by, for instance, an overhead condensor system.

The filtrate product obtained from the clay contacting step may be suitable for non-critical oil uses, that is those uses in which color is not an important requirement. Otherwise the filtrate product may be further processed by conventional oil upgrading techniques including hydrotreating, vacuum distillation and acid-clay contacting.

The invention is further illustrated by the following examples.

EXAMPLE I

A number of oil samples were taken from a feedstock of waste lubricating oil and subjected to the various treatments to be described. The oil was a typical wet waste oil without preliminary dehydration, light-ends removal or demetallization treatment. Prior to each run the oil was air rolled to ensure sample uniformity. A typical metal analysis of the untreated waste oil is given in Table I. Three liter samples of the waste oil were transferred to a 5 l., 3-necked distillation flask equipped with either a steam or nitrogen purge and an overhead condenser for light ends stripping. The desired amount of decolorizing clay was added to the oil and the clay-oil mixture heated to 650° F. The decolorizing clays used are specified in Table I. This temperature was maintained for a reaction time of about 4 hours and the mixture was then cooled. Light ends stripping was maintained throughout the heating, constant temperature and cooling phases. The oil-clay mixture was allowed to cool and settle overnight. On the following day the mixture was reslurried, heated to about 200° F. and gravity filtered.

The composition and amount of stripped overhead together with the analysis of the filtered product are reported in Table I and II. The metal contaminant content was determined by atomic absorption. The filtered product is indicated in the columns headed "Before Hydrotreatment (Hyd)".

To illustrate that the filtered product obtained from the clay contacting process at an elevated temperature was acceptable to conventional upgrading processes, the product was subjected to hydrotreating and vacuum distillation techniques.

The filtered products were hydrotreated in a batch hydrotreater at 650° F. and 650 psig for 4 hours using a Nalco DS 471 Co-Mo catalyst (Alchem, Edmonton, Alberta). After hydrotreatment the product was filtered to remove catalyst fines and $H_2S$ and then analyzed. The analyses are reported in Table II in the columns headed "After Hydrotreatment (Hyd)".

From the product analyses after hydrotreatment it can be seen that the preliminary clay contacting process of the present invention produced an oil product sufficiently reduced in contaminants to be upgraded by conventional hydrotreating. From the metal analyses in Table I, it can be seen that the filtered oil product, prior to hydrotreating, is suitable for non-critical oil uses.

The hydrotreated product was then vacuum distilled at 10 mm Hg in a 5-tray column. Two 1,500 ml and two 1,000 ml distillations were made with the residue from the previous runs being left in the distillation flask. Reflux ratios were varied from total take-off to 5:1. Light ends, centre cut and residue amounts together with their analyses are reported in Table III.

It is significant to note that the majority of the remaining color bodies concentrate in the residue fraction leaving relatively clean oil products.

To illustrate the effect of an acid-clay treatment subsequent to the above described clay contacting process, the following example was performed.

The waste lubricating oil was treated with 4% by weight clay at 650° F. for 4 hours to yield a filtered product having a viscosity of 162.4 SUS at 100° F. and of 44.14 SUS at 210° F. The filtered product was subsequently contacted with 0.5% vol/vol $H_2SO_4$ and filtered. Further clay contacting with 4% vol Pembina clay at 300° F. gave a filtered product having a color of 4½–5.

To obtain a similar color reduction by a straight forward acid-clay treatment would require approximately 6% vol/vol $H_2SO_4$. Thus the preliminary clay contacting step at an elevated temperature significantly reduces the quantity of acid consumed.

TABLE III-continued

PROPERTIES OF FEED AND VACUUM DISTILLATION CUTS

| | Color | Flash Pt. °F. | Vis @ 100° F. SUS | Vis @ 210° F. SUS | A.P.I. Grav. @ 60° F. |
|---|---|---|---|---|---|
| (A.T.-C.C.) | | | | | |

EXAMPLE II

This example is intended to show the criticality of the temperature range.

Five hundred milliliter samples of waste lubricating oil were each contacted with 25 g of Pembina 105 clay at the temperatures indicated in the accompanying table. The contacting step was performed in a 2 . flask equipped with a nitrogen sparger, a thermometer and a condensor. Light ends were removed from the top of the condensor. The nitrogen sparger agitated the oil mixture during the reaction. The rate of heating was controlled so that the desired temperature was reached in 1.5 hours. This temperature was held for the time indicated in the accompanying table. The mixture was then cooled to 350° F. and filtered. Filtering was performed under vacuum using a Whatman #4 filter paper placed above a Whatman #1 paper. This filtering system was used as it was found to give the best results in the process of the present invention. The filtration time is recorded in Table IV, along with the product analyses. Colour was determined by a Hellige Comparator and the metals content was determined by atomic absorption.

TABLE I

METAL CONTAMINANT CONTENT OF WASTE OIL BEFORE AND AFTER CLAY CONTACTING

| Decolorizing Clay 2.5 wt. vol. % | Sn | Pb | Cu | Al | Si | Fe | Cr | Ag | Zn | Mg | Ni | Ba | Na | Ca | V | P | Mo | B | Mn |
|---|---|---|---|---|---|---|---|---|---|---|---|---|---|---|---|---|---|---|---|
| Untreated waste oil | 10 | 7845 | 35 | 25 | 30 | 485 | 15 | 0 | 1380 | 350 | 3 | 210 | 90 | 1490 | 2 | 950 | 2 | 20 | 20 |
| Filtrol Clay | 0 | 0 | 0 | 0 | 4 | 0 | 0 | 0 | 1 | 0 | 0 | 0 | 0 | 0 | 0 | 12 | 0 | 0 | 0 |
| Attapulgus Clay | 0 | 0 | 0 | 0 | <1 | 0 | 0 | 0 | <1 | 0 | 0 | 0 | 0 | 0 | 0 | 7 | 0 | 0 | 0 |
| Pembina 105 Clay | 0 | 0 | 0 | 0 | 0 | 0 | 0 | 0 | 2 | 0 | 0 | 0 | 0 | 0 | 0 | 22 | 0 | 0 | 0 |
| Pembina 75 Clay | 0 | 0 | 0 | 0 | 0 | 0 | 0 | 0 | <1 | 0 | 0 | 0 | 0 | 0 | 0 | 17 | 0 | 0 | 0 |
| Fullers Earth | 0 | 0 | 0 | 0 | 0 | 0 | 0 | 0 | <1 | 0 | 0 | 0 | 0 | 0 | 0 | 6 | 0 | 0 | 0 |

TABLE II

OIL FILTRATE ANALYSIS AFTER TREATMENT WITH PEMBINA CLAY

| Conditions | | | Product - Base | | | | | | | | | Product - Overhead | |
|---|---|---|---|---|---|---|---|---|---|---|---|---|---|
| | | | Colour | | Flash Point °F. | | Vis @ 100° F. SUS | | Vis @ 210° F. SUS | | Vis Index | | |
| Temp. °F. | Clay % wt | Time Hours | Before Hyd. | After Hyd. | Before Hyd. | After Hyd. | Before Hyd. | After Hyd. | Before Hyd. | After Hyd. | Before Hyd. | % Removed as Light Ends | Vis @ 100° F. SUS |
| 650 | 0 | 4 | >8 | 4½/5 | 445 | 400 | 331.8 | 270.0 | 53.86 | 50.78 | 95 | 35.0 | 49.03 |
| 650 | 2 | 4 | >8 | 4½/5 | 400 | 400 | 193.6 | 189.1 | 46.01 | 45.69 | 98 | 20.0 | 35.42 |
| 650 | 4 | 4 | >8 | 4½/5 | 400 | 385 | 178.2 | 168.9 | 44.43 | 43.39 | 87 | 29.0 | 41.16 |
| 650 | 5 | 4 | >8 | 3½/4 | 405 | 400 | 178.8 | 167.9 | 45.23 | 44.56 | 101 | 27.0 | 46.81 |
| 650 | 6 | 4 | >8 | 3½/4 | 425 | 390 | 202.6 | 193.3 | 45.85 | 45.33 | 86 | 30.0 | 40.07 |
| 650 | 8 | 4 | 6/7 | 3/3½ | 430 | 425 | 225.5 | 207.1 | 47.95 | 47.01 | 97 | 45.0 | 47.30 |
| 650 | 10 | 4 | 6/7 | 2/2½ | 410 | 405 | 166.7 | 156.7 | 44.46 | 43.88 | 102 | 30.00 | — |
| 650 | 10 | 3 | 6/7 | 2/2½ | 390 | 355 | 145.7 | 141.4 | 42.87 | 42.62 | 99 | 18.0 | 33.42 |
| 650 | 10 | 2 | >8 | 2/2½ | 380 | 350 | 157.1 | 146.2 | 43.59 | 42.91 | 98 | 15.0 | 33.27 |
| 650 | 5 | 4 | >8 | 4½/4 | 385 | 325 | 170.2 | 152.9 | 44.65 | 43.59 | 101 | 13.7 | 32.15 |

TABLE III

PROPERTIES OF FEED AND VACUUM DISTILLATION CUTS

| | Color | Flash Pt. °F. | Vis @ 100° F. SUS | Vis @ 210° F. SUS | A.P.I. Grav. @ 60° F. |
|---|---|---|---|---|---|
| Feed | 4–4½ | 325 | 152.9 | 44.65 | 30.0 |
| Forecut | 1–1½ | 250 | 41.2 | — | 36.4 |
| Centre Cut | 1–1½ | 405 | 140.1 | 42.29 | 31.1 |
| Residue | 8 | 560 | 1078.3 | 90.23 | 27.2 |
| Residue | 3½–4 | 550 | 990.9 | 87.20 | 28.0 |

It will be noted that, when the clay contacting-heating step is carried out at temperatures below 650° F., the product clay-oil mixture was not readily filterable. When carried out in the range 650°–725° F., the mixture filters readily.

TABLE IV

| CLAY CONTACTING* | | | | | | | PRODUCT ANALYSIS | | | | | | | | | |
|---|---|---|---|---|---|---|---|---|---|---|---|---|---|---|---|---|
| | | Results | | | | | | | | | | | | | | |
| | | Stripping | | | Filtration** | | Physical Properties | | | | Chemical | | | | | |
| Conditions | | | | | | | Colour | Viscosity | | | Metals by Atomic Adsorption | | | | | |
| Temp. °F. | Time hrs. | Total mls | Water mls | Hydro-carbons mls | Fil-trate % | Filter Time mins. | NPA Units | 40° C. cst | 100° C. cst | Appear-ance | Pb ppm | Ca ppm | Al ppm | Si ppm | Fe ppm | Zn ppm |
| — | — | — | — | — | — | — | 8+ | 40.33 | 6.58 | Black, dirty | 903 | 615 | 14.6 | 47.5 | 63.5 | 778 |
| 500 | 4 | 50 | 32 | 18 | 4.4 | 60+ | 8+ | 43.66 | 7.26 | Black, dirty | 228 | 172 | 11.1 | 37.5 | 76.5 | 162 |
| 650 | 4 | 72 | 30 | 42 | 100 | 7 | 8+ | 35.33 | 5.85 | Brown-Green Fluor-escent | 8.2 | 24.7 | 0.1 | 2.4 | 0.1 | 3.0 |
| 725 | 1 | 106 | 31 | 75 | 100 | 7 | 6–7 | 32.97 | 5.56 | Brown, Green Fluor-escent | 8.6 | 23.9 | 0.1 | 2.1 | 0.4 | 1.9 |
| 600 | 1 | 66 | 33 | 33 | 12.8 | 60+ | 8+ | 43.50 | 6.90 | Brown, clear | 88.0 | 152 | 5.1 | 16.5 | 102 | 132 |
| 725 | 0.5 | 102 | 32 | 70 | 100 | 8 | 6–7 | 35.25 | 5.78 | Brown, Green Fluor-escent | 8.4 | 21.9 | 0.1 | 1.0 | 0.1 | 1.3 |

*Clay content 5%, under nitrogen flow of 25 mls per minute
**Filtration at 350° F.

EXAMPLE III

TABLE V

| Contacting Temp. (°F.) | Contacting Time (hrs.) | Time (min.) to Filter Percentage of Product 0% | 25% | 50% | 75% | 90% | 100% | Viscosity (cst.) 40° C. | 100° C. | Metal Analysis (ppm) Fe | Al | Pb | Zn | Ca | Si |
|---|---|---|---|---|---|---|---|---|---|---|---|---|---|---|---|
| 0 | 0 | | | | | | | 40.33 | 6.58 | 63.5 | 14.6 | 903 | 778 | 615 | 47.5 |
| 650 | 4 | 0 | 2 | 5 | 9 | | 15 | 35.55 | 5.72 | 2.3 | 1.0 | 6.5 | 4.2 | 21.7 | 5.2 |
| 650 | 2 | 0 | 6 | 15 | 60 | 240 | | 37.73 | 6.07 | 2.5 | 1.4 | 19.6 | 6.5 | 23.2 | 6.0 |
| 650 | 3 | 0 | 3 | 6 | 10 | | 18 | 35.57 | 5.88 | 2.1 | 1.0 | 10.2 | 4.5 | 19.6 | 4.6 |
| 650 | 1 | After 4 hrs ≈ 60% of product filtered | | | | | | 38.37 | 6.17 | 10.5 | 3.0 | 71.7 | 6.4 | 32.9 | 7.1 |
| 650 | 0.5 | After 4 hrs ≈ 30% of product filtered | | | | | | 40.21 | 6.39 | 15.9 | 3.5 | 116.5 | 13.8 | 70.8 | 7.8 |
| 600 | 4 | After 4 hrs ≈ 15% of product filtered | | | | | | 40.89 | 6.67 | 16.7 | 3.5 | 105.4 | 15.2 | 72.1 | 8.0 |
| 600 | 1 | After 4 hrs ≈ 5% of product filtered | | | | | | 43.40 | 6.71 | 88.0 | 8.3 | 155.0 | 147.0 | 162.0 | 27.0 |

In this example, runs were conducted with samples of one used oil at two temperatures with varying retention times at each temperature, to show that the success of the clay contacting-heating step is time and temperature dependent.

In each run, 500 ml of waste lubricating oil was contacted with 25 g of Pembina 105 clay and heated under nitrogen over 1.5 hours to reach the desired temperature (650° F. or 600° F.). The oil mixture was held at that temperature for a time varying from 0.5 to 4 hours while light ends were removed overhead. The mixture was then immediately cooled to about 350° F. and filtered. The filtration step was performed through an 11 cm. Buchner funnel lined with a #4 and a #1 Whatman filter into a 1 . filter flask held at about 10 mm Hg vacuum. The time needed to filter varying percentages of the oil mixture was recorded. The filtrate product was analyzed by atomic absorption for metals content. The viscosity of the filtrate was also measured. The results are reported in Table V.

It will be noted that to render this sample of oil filterable, the clay contacting heating step should be carried out at 650° F. for greater than 2 hours. When heated below 650° F., the used oil was not readily filterable.

While the present invention has been disclosed in connection with the preferred embodiments thereof, it should be understood that there may be other embodiments which fall within the spirit and scope of the present invention as defined by the following claims.

The embodiments of the invention in which an exclusive property or privilege is claimed are defined as follows:

1. A process for the removal of contaminants from untreated waste lubricating oil, containing detergent dispersant agents, comprising the steps of:
   (a) contacting the untreated waste oil with a decolourizing clay at a temperature in the range of about 650°–725° F. for a time sufficient to render the mixture readily filterable whereby at least a portion of the contaminants may be separated with the clay from the oil; and then
   (b) immediately cooling and filtering the whole product of step (a) to obtain as a filtrate the greatest part of the oil, reduced in contaminant content.

2. The process as set forth in claim 1 which further comprises:
   stripping the light ends simultaneously with the clay contacting step.

3. The process as set forth in claim 1 wherein:
   the decolorizing clay is selected from the group consisting of Filtrol clay, Pembina clay, attapulgus clay and Fullers Earth.

4. The process as set forth in claim 3 wherein:
the amount of clay used is in the range of about 2–6 weight percent.

5. The process as set forth in claim 4 wherein:
the filtration step is performed at a temperature in the range of about 200°–350° F.

6. The process as set forth in claim 1 wherein:
the clay contacting step is performed in a hydrogen atmosphere, at a temperature in the range of about 650°–675° F.

7. The process as set forth in claim 6 wherein:
the decolorizing clay is selected from the group consisting of Filtrol clay, Pembina clay, attapulgus clay and Fullers Earth.

8. The process as set forth in claim 7 wherein:
the amount of clay used in the oil is in the range of about 2–6 weight percent.

9. The process as set forth in claim 8 wherein:
the filtration step is performed at a temperature in the range of about 200°–350° F.

10. The process as set forth in claim 9 wherein:
a hydrogen pressure in the range of about 100–800 psig is used.

11. The process as set forth in claims 3 or 7 which further comprises the step of:
subsequent to the filtration step, hydrotreating the filtrate product to remove additional contaminants.

12. The process as set forth in claims 3 or 7 which further comprises the step of:
subsequent to the filtration step, vacuum distilling the filtrate product to remove additional contaminants.

13. The process as set forth in claims 3 or 7 which further comprises the step of:
subsequent to the filtration step, contacting the filtrate product with sulphuric acid and removing additional contaminants in an acid sludge.

* * * * *